US011969092B2

(12) United States Patent
Springer et al.

(10) Patent No.: US 11,969,092 B2
(45) Date of Patent: Apr. 30, 2024

(54) ADJUSTABLE SHELF SUPPORT

(71) Applicant: Sub-Zero Group, Inc., Madison, WI (US)

(72) Inventors: Brant David Springer, Janesville, WI (US); Michelle Flachs Croce, Verona, WI (US)

(73) Assignee: Sub-Zero Group, Inc., Madison, WI (US)

( * ) Notice: Subject to any disclaimer, the term of this patent is extended or adjusted under 35 U.S.C. 154(b) by 45 days.

(21) Appl. No.: 17/746,005

(22) Filed: May 17, 2022

(65) Prior Publication Data

US 2022/0386775 A1 Dec. 8, 2022

Related U.S. Application Data

(60) Provisional application No. 63/196,259, filed on Jun. 3, 2021.

(51) Int. Cl.

| | |
|---|---|
| ***F25D 25/02*** | (2006.01) |
| ***A47B 96/06*** | (2006.01) |
| ***F25D 23/06*** | (2006.01) |

(52) U.S. Cl.

CPC ..... *A47B 96/06* (2013.01); *F25D 23/067* (2013.01); *F25D 25/02* (2013.01); *A47B 2220/0036* (2013.01); *F25D 2325/023* (2013.01)

(58) Field of Classification Search

CPC ..... A47B 96/06; A47B 96/068; A47B 96/024; A47B 2220/0036; A47B 57/06; A47B 57/08; A47B 57/567; A47B 57/565; F25D 25/02; F25D 25/04; F25D 2325/023; F25D 23/067

See application file for complete search history.

(56) References Cited

U.S. PATENT DOCUMENTS

| | | | | | |
|---|---|---|---|---|---|
| 427,462 | A * | 5/1890 | Crider | A47B 57/567 248/244 |
| 2,420,173 | A * | 5/1947 | Hall | F25D 25/02 312/351 |
| 2,517,385 | A * | 8/1950 | Clark | F25D 25/02 211/90.03 |
| 3,545,387 | A * | 12/1970 | Giambalvo | A47B 57/26 403/240 |
| 11,460,233 | B2 * | 10/2022 | Torres | F25C 5/22 |
| 2021/0033328 | A1 * | 2/2021 | Torres | F25C 5/22 |

FOREIGN PATENT DOCUMENTS

| | | | | |
|---|---|---|---|---|
| EP | 1512928 | A3 * | 6/2006 | A47B 57/10 |
| KR | 470666 | Y1 * | 1/2014 | |
| WO | WO-2017185150 | A1 * | 11/2017 | |

* cited by examiner

*Primary Examiner* — Kimberley S Wright
(74) *Attorney, Agent, or Firm* — Bell & Manning, LLC

(57) ABSTRACT

An adjustable shelf support includes a fastener, a stationary support, and a slidable support. The stationary support includes a first body, a first aperture formed through the first body, and a first plurality of ledges that protrude outward away from the first body. The slidable support includes a second body, a second aperture formed through the second body, and a second plurality of ledges that protrude outward away from the second body. A ledge of the second plurality of ledges is positioned on a ledge of the first plurality of ledges. The fastener is inserted through the second aperture and the first aperture to further mount the slidable support to the stationary support.

20 Claims, 17 Drawing Sheets

ADJUSTABLE SHELF SUPPORT

CROSS REFERENCE TO RELATED APPLICATIONS

The present application claims priority to U.S. provisional patent application No. 63/196,259 that was filed Jun. 3, 2021, the entire contents of which are incorporated herein by reference.

BACKGROUND

In some devices, shelves may be configured to rotate relative to a fixed edge so that the shelf can be moved to accommodate taller objects on a lower shelf. Releasable connectors formed in interior walls for a shelf, for example, in a refrigerator, may vary due to manufacturing tolerances or refrigerator design differences between different models. An adjustable shelf support is needed to properly level the shelf in response to the tolerances and/or differences.

SUMMARY

In an example embodiment, an adjustable shelf support is provided. The adjustable shelf support includes, but is not limited to, a fastener, a stationary support, and a slidable support. The stationary support includes, but is not limited to, a first body, a first aperture formed through the first body, and a first plurality of ledges that protrude outward away from the first body. The slidable support includes, but is not limited to, a second body, a second aperture formed through the second body, and a second plurality of ledges that protrude outward away from the second body. A ledge of the second plurality of ledges is positioned on a ledge of the first plurality of ledges. The fastener is inserted through the second aperture and the first aperture to further mount the slidable support to the stationary support.

In another example embodiment, an adjustable shelf is provided. The adjustable shelf includes, but is not limited to, a fixed support bracket, an item support surface, a shelf support bar mounted to the item support surface, and the adjustable shelf support. The shelf support bar includes, but is not limited to, a first edge and a second edge. The first edge is on an opposite side of the shelf support bar relative to the second edge. The second edge is mounted to the fixed support bracket. The first edge is mounted to the slidable support.

In another example embodiment, a refrigerator is provided. The refrigerator includes, but is not limited to, a plurality of walls, a door mounted to a wall of the plurality of walls, a refrigeration system, a fixed support bracket mounted to a first interior wall within the refrigerator, an item support surface, a shelf support bar mounted to the item support surface, and a first adjustable shelf support. The plurality of walls and the door define an enclosed space. The shelf support bar includes, but is not limited to, a first edge and a second edge. The first edge is on an opposite side of the shelf support bar relative to the second edge. The second edge is mounted to the fixed support bracket. The first adjustable shelf support includes, but is not limited to, a first fastener, a first stationary support mounted to a second interior wall within the refrigerator, and a first slidable support. The first stationary support includes, but is not limited to, a first body, a first aperture formed through the first body, and a first plurality of ledges that protrude outward away from the first body. The first slidable support includes, but is not limited to, a second body, a second aperture formed through the second body, and a second plurality of ledges that protrude outward away from the second body. A ledge of the second plurality of ledges is positioned on a ledge of the first plurality of ledges. The first fastener is inserted through the second aperture and the first aperture. The first edge is mounted to the first slidable support.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
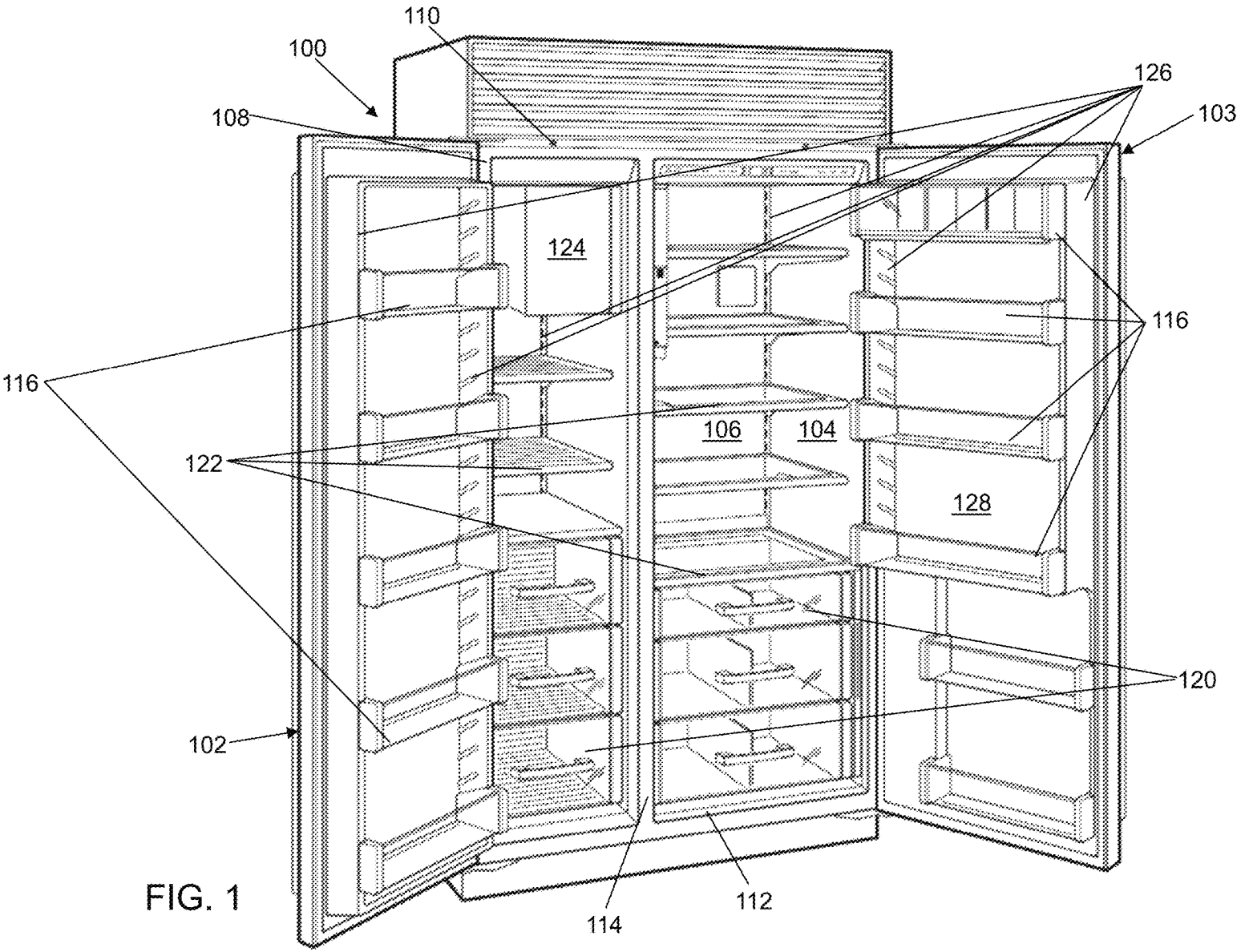
FIG. 1 depicts a left, front perspective view of a refrigerator in accordance with an illustrative embodiment.

Referring to FIG. 1, a left, front, perspective view of a refrigerator 100 is shown in accordance with an illustrative embodiment. Refrigerator 100 may include one or more compartments or cooling zones. Refrigerator 100 may include a freezer compartment door 102, a refrigerator compartment door 103, a right side wall 104, a back wall 106, a left side wall 108, a top wall 110, a bottom wall 112, and a divider wall 114. In the illustrative embodiment, freezer compartment door 102 is rotatably mounted to top wall 110 and bottom wall 112 adjacent left side wall 108 using two hinges, and refrigerator compartment door 103 is rotatably mounted to top wall 110 and bottom wall 112 adjacent right side wall 104 using another two hinges. In alternative embodiments, freezer compartment door 102 and/or refrigerator compartment door 103 may be rotatably mounted to different walls of refrigerator 100 using a fewer or a greater number of hinges.

Freezer compartment door 102 provides access to a freezer compartment defined by top wall 110, left side wall 108, bottom wall 112, back wall 106, divider wall 114, and freezer compartment door 102 when freezer compartment door 102 is in a closed position. Refrigerator compartment door 103 provides access to a refrigerated compartment defined by top wall 110, right side wall 104, bottom wall 112, back wall 106, divider wall 114, and refrigerator compartment door 103 when refrigerator compartment door 103 is in a closed position.

Divider wall 114 separates the freezer compartment from the refrigerator compartment. In the illustrative embodiment, divider wall 114 extends vertically between top wall 110 and bottom wall 112. Of course, in alternative embodiments, divider wall 114 may extend horizontally to separate the two compartments with the freezer compartment either above or below the refrigerated compartment. Additionally, in alternative embodiments, the locations of the freezer compartment and the refrigerated compartment may be reversed. Further, refrigerator 100 may include a greater or a fewer number of compartments in various arrangements horizontally or vertically with respect to each other.

Though shown in the illustrative embodiment as forming a generally rectangular shaped enclosure, refrigerator 100 may form any shaped enclosure including other polygons as well as circular or elliptical enclosures. As a result, freezer compartment door 102, refrigerator compartment door 103, and the walls forming refrigerator 100 may have any shape including other polygons as well as circular or elliptical shapes.

Various storage devices may be housed within the enclosed space(s) of refrigerator 100. For example, zero or more drawers 120, shelves 122, or other receptacles may be mounted within the freezer compartment and the refrigerator compartment. An ice maker/dispenser 124 may be mounted within the freezer space to make and store ice. Zero or more door shelves 116 may be mounted to either or both of freezer compartment door 102 and refrigerator compartment door 103.

The storage devices may mount to various walls of refrigerator 100, to freezer compartment door 102, and/or to refrigerator compartment door 103 using one or more ladders 126 that are mounted to a wall of refrigerator 100, a wall of freezer compartment door 102, or a wall of refrigerator compartment door 103. For example, a right mounting ladder and a left mounting ladder of the one or more ladders 126 may be mounted to an interior door plate 128 of refrigerator compartment door 103. The one or more ladders 126 may be configured so that a mounting mechanism of a respective drawer, shelf, or other receptacle is attached to a rung of the ladder or between a pair of ladder rungs as understood by a person of skill in the art. For example, the mounting mechanism may include a hook that is mounted to the storage device and over a rung of the ladder or between a pair of ladder rungs to position the storage device within the enclosed space, on freezer compartment door 102, or on refrigerator compartment door 103. As another example, the mounting mechanism may include a pin that is mounted to the storage device and inserted in a rung of the ladder or between a pair of ladder rungs to position the storage device within the enclosed space, on freezer compartment door 102, or on refrigerator compartment door 103. As yet another example, the mounting mechanism may include an aperture that is mounted to the storage device and to a pin mounted as a rung of the ladder to position the storage device within the enclosed space, on freezer compartment door 102, or on refrigerator compartment door 103. Other mounting mechanisms may be used such as adhesive, soldering, etc. Zero or more of the storage devices may be mountable to different ladder rungs to change a position of the storage container within the enclosed space, on freezer compartment door 102, or on refrigerator compartment door 103.

A temperature of one or more refrigerated compartments of refrigerator 100 may be maintained at an adequate temperature to preserve fresh food using a refrigeration system (not shown) as understood by a person of skill in the art, and a temperature of one or more freezer compartments may be maintained at an adequate temperature to maintain food stored therein in a frozen state using a second refrigeration system (not shown) as understood by a person of skill in the art.

A refrigerator controller (not shown) may control a flow of refrigerant through each refrigeration system of refrigerator 100. Refrigerator 100 may include one or more refrigeration systems. Refrigeration system components, such as a compressor, a condenser, an evaporator, a dryer, etc., may be mounted to various walls of refrigerator 100 either within the walls, on an exterior of the walls relative to refrigerator 100, and/or on an interior of the walls relative to refrigerator 100.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled such that freezer compartment door 102 and refrigerator compartment door 103 define a front of refrigerator 100.

As understood by a person of skill in the art, the walls that form refrigerator 100 are insulated walls that include insulation to assist in maintenance of the desired temperature in the freezer and refrigerator compartments. Electrical wiring and various conduits may further be located in the insulated walls. For example, during a manufacturing process, a space between exterior walls of refrigerator 100 and an interior liner may be filled with a foam material that provides insulation. Freezer compartment door 102 and refrigerator compartment door 103 further may include insulated walls.

Figure 2:
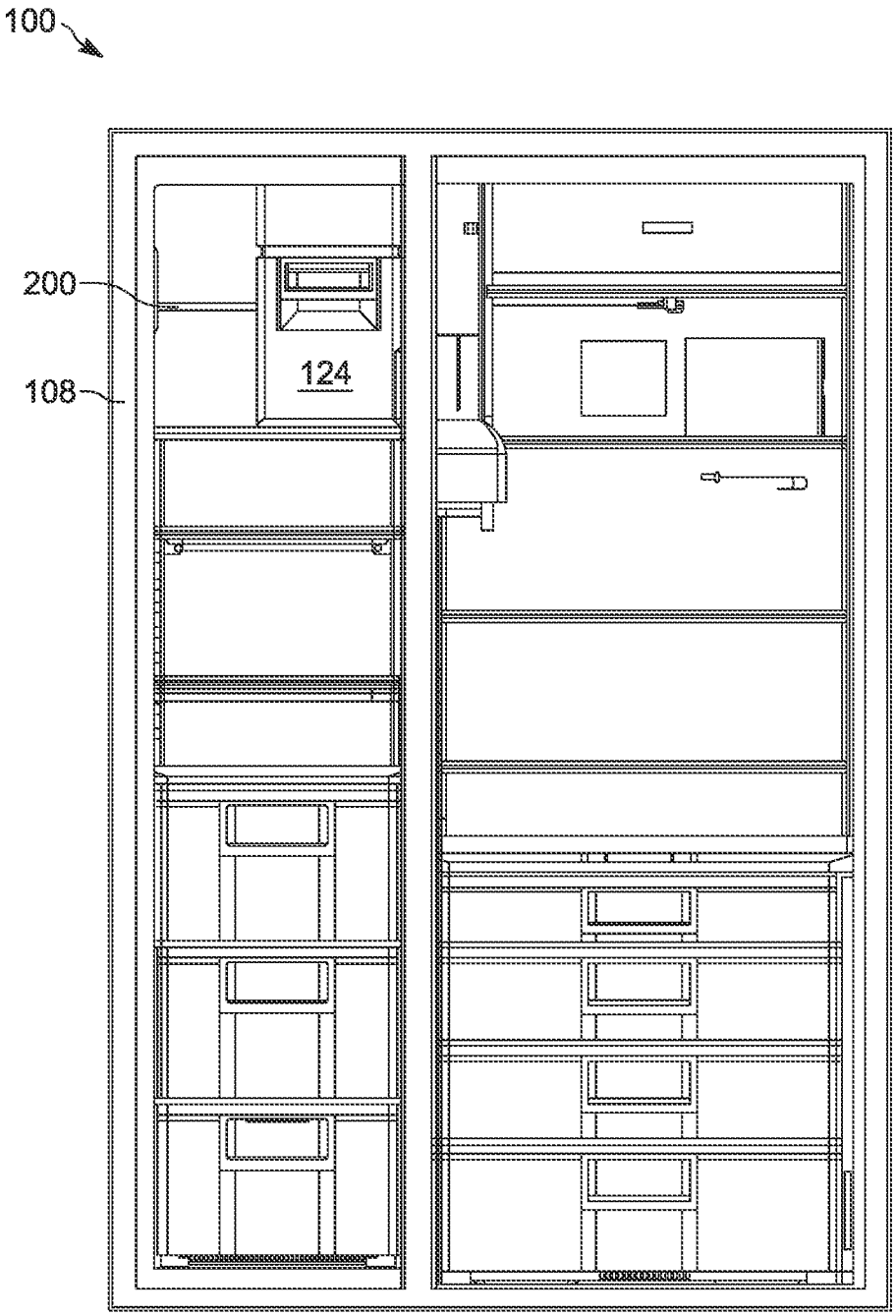
FIG. 2 depicts a front view of a cabinet of the refrigerator of FIG. 1 in accordance with an illustrative embodiment.

Referring to FIG. 2, a front view of refrigerator 100 is shown in accordance with an illustrative embodiment with freezer compartment door 102 and refrigerator compartment door 103 removed. An adjustable shelf 200 is positioned between ice maker/dispenser 124 and left side wall 108 though adjustable shelf 200 may positioned between other items housed within refrigerator 100 including between any pair of walls of refrigerator 100. Adjustable shelf 200 may be mounted within refrigerator 100 to rotate up or down relative to a fixed edge.

Figure 3:
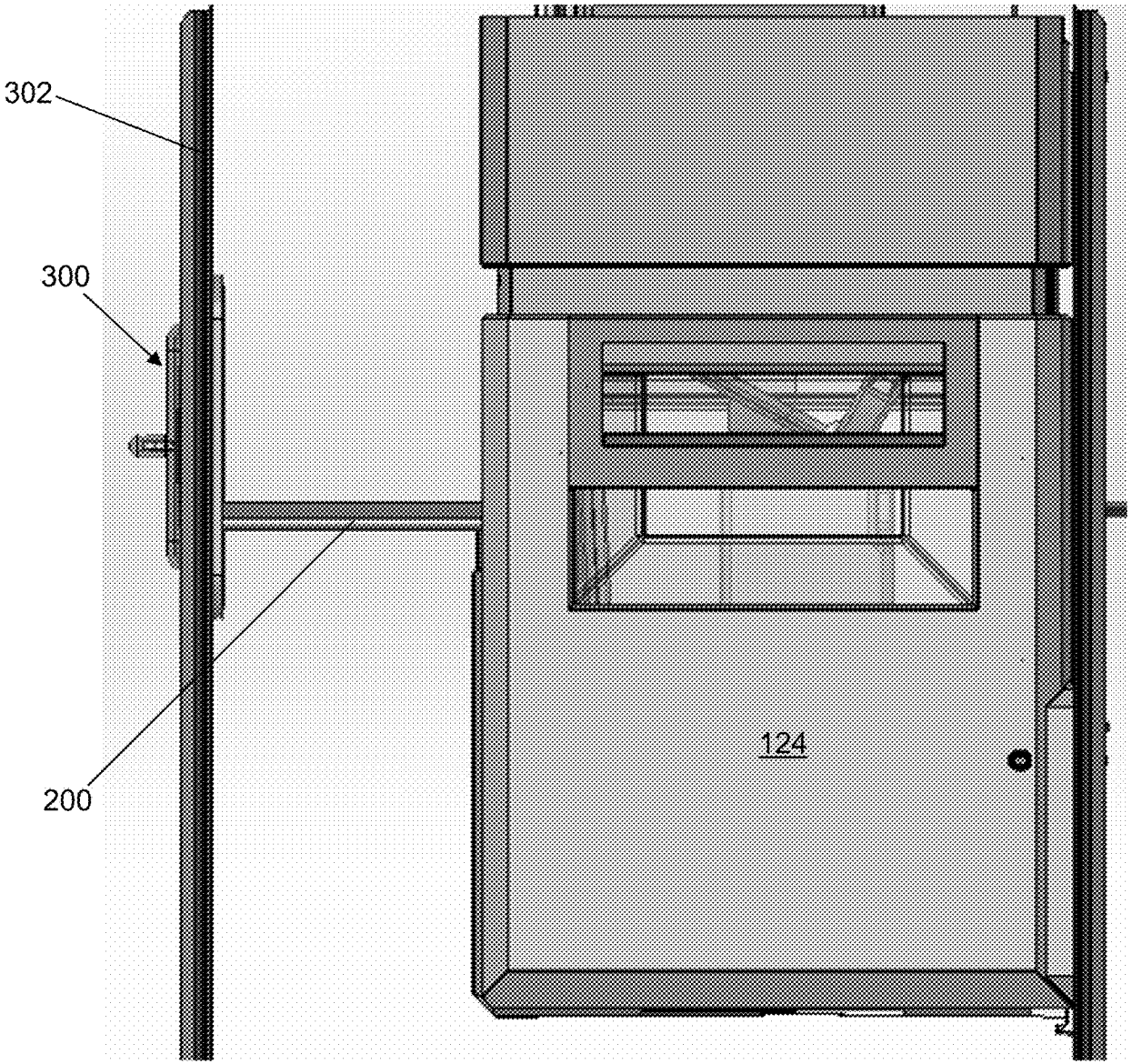
FIG. 3 depicts a front view of an ice maker portion of the cabinet of FIG. 2 in accordance with an illustrative embodiment.
Figure 4:
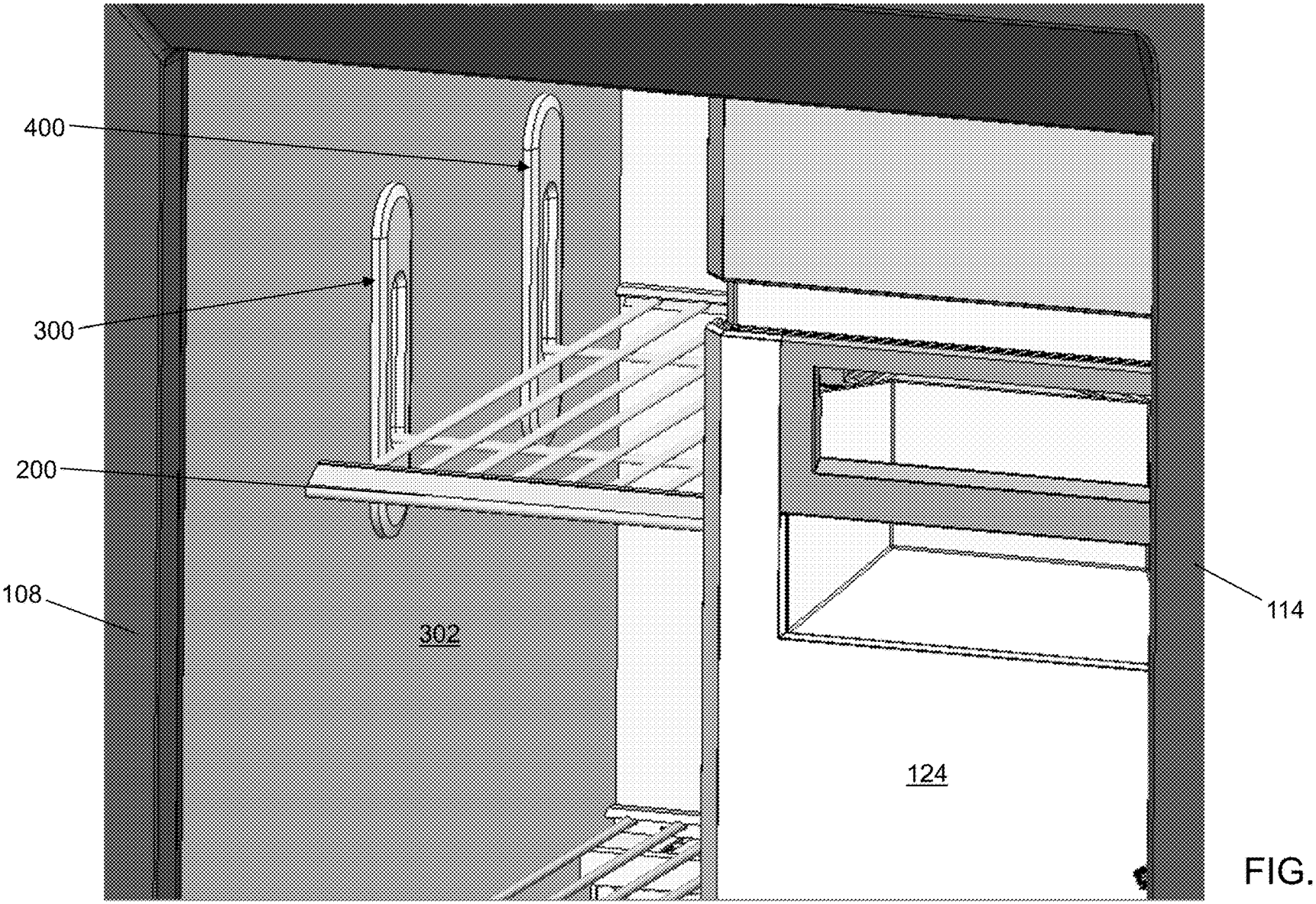
FIG. 4 depicts a right, front perspective view of the ice maker portion of the cabinet of FIG. 2 in accordance with an illustrative embodiment.
Figure 5:
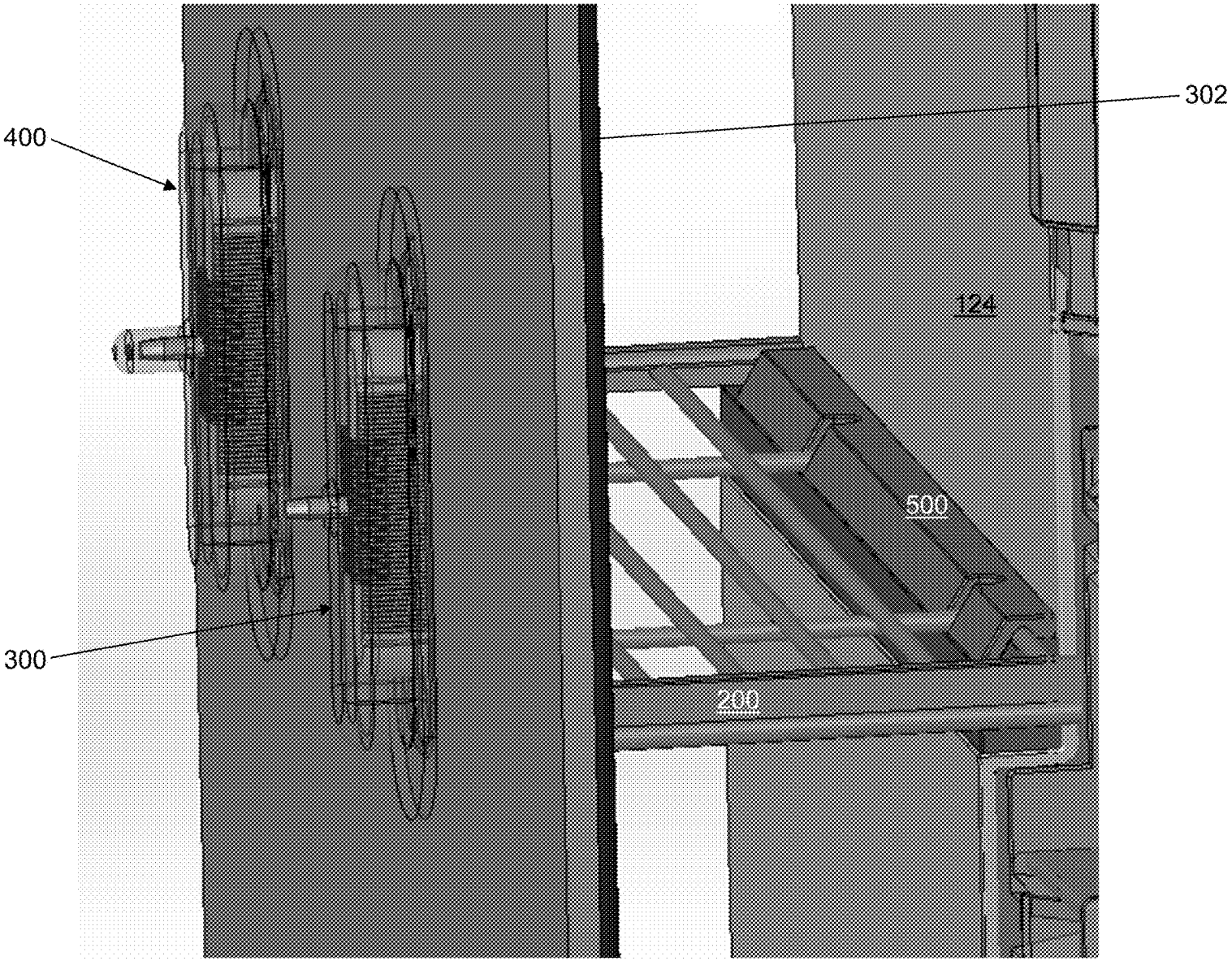
FIG. 5 depicts a left, front perspective view of the ice maker portion of the cabinet of FIG. 2 with a portion of a sidewall removed in accordance with an illustrative embodiment.

Referring to FIG. 3, a front view is shown of an ice maker portion of refrigerator 100 in accordance with an illustrative embodiment. Referring to FIG. 4, a right, front perspective view is shown of the ice maker portion of FIG. 3 in accordance with an illustrative embodiment. Referring to FIG. 5, a left, front perspective view is shown of the ice maker portion of FIG. 3 with a portion of left side wall 108 removed in accordance with an illustrative embodiment.

A first adjustable shelf support 300 and a second adjustable shelf support 400 mount to an interior liner wall 302 of left side wall 108 in the illustrative embodiment. Adjustable shelf 200 can rotate upward about a fixed support bracket 500 that mounts to a left sidewall of ice maker/dispenser 124 so that taller items can be stored to the left of ice maker/dispenser 124 on a support surface below adjustable shelf 200. Fixed support bracket 500 may include a locking feature (not shown) that holds adjustable shelf 200 in the upright position when not being used as a shelf to support items. In the illustrative embodiment, fixed support bracket 500 abuts and extends along the left sidewall of ice maker/dispenser 124. Fixed support bracket 500 may be mounted to other walls of refrigerator 100 using various types of fasteners such as screws. When taller items do not need to be stored in the space otherwise occupied by adjustable shelf 200, adjustable shelf 200 can be rotated downward until a first bar edge 614 and a second bar edge 616 of a shelf support bar 600 of adjustable shelf 200 are supported horizontally by first adjustable shelf support 300 and second adjustable shelf support 400, respectively.

Figure 6:
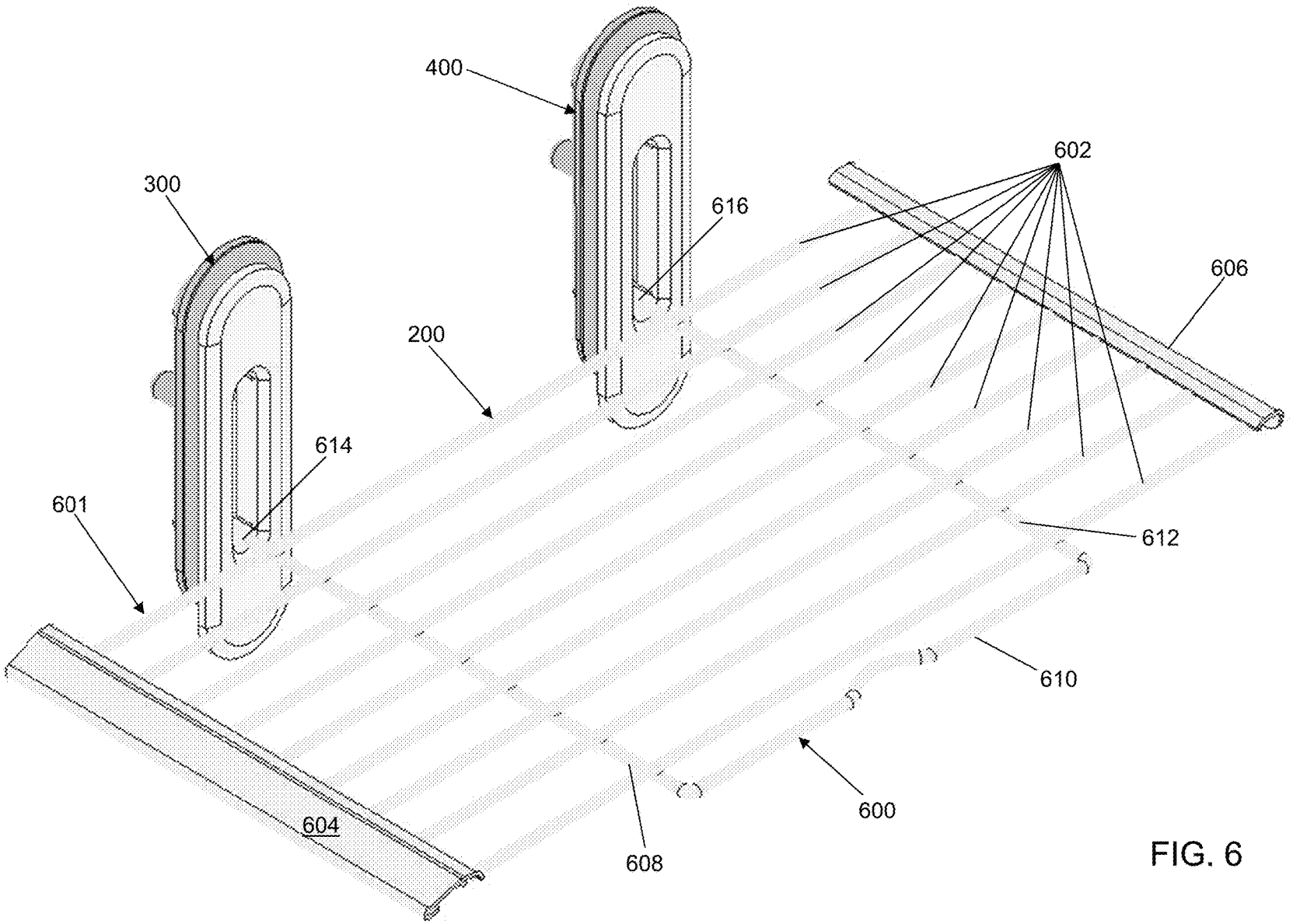
FIG. 6 depicts a right, front perspective view of a shelf and adjustable shelf supports in accordance with an illustrative embodiment.
Figure 7:
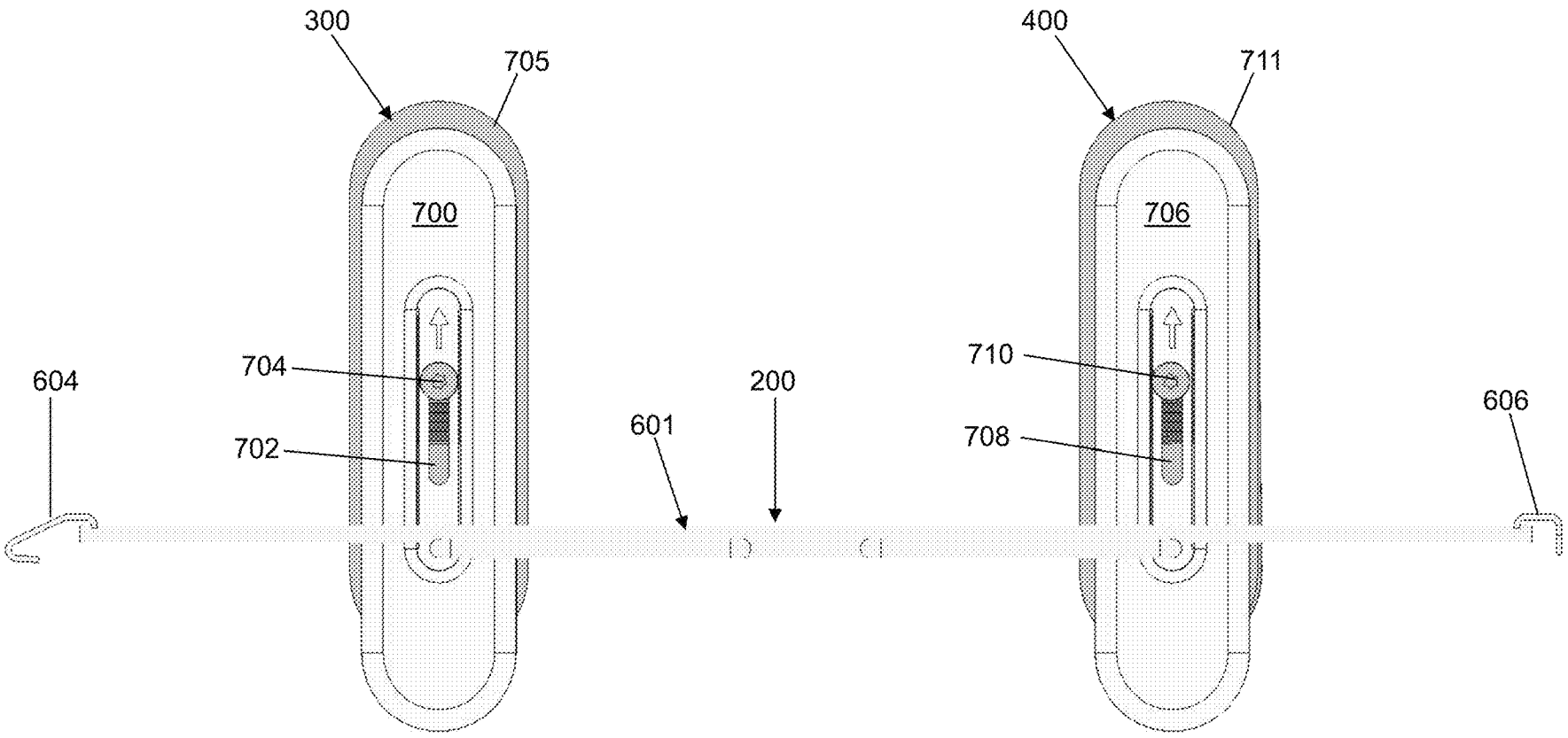
FIG. 7 depicts a right view of the shelf and adjustable shelf supports of FIG. 6 in accordance with an illustrative embodiment.
Figure 8:
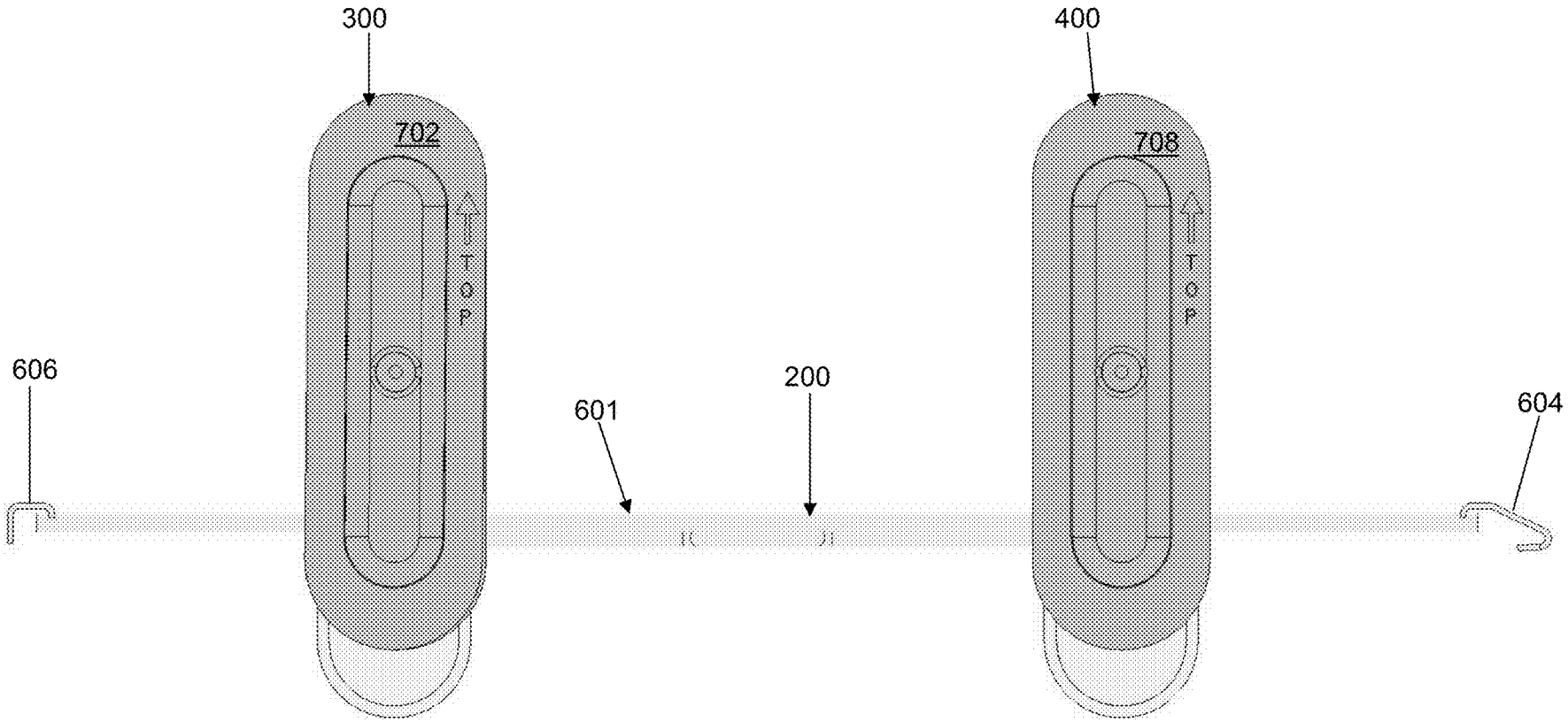
FIG. 8 depicts a left view of the shelf and adjustable shelf supports of FIG. 6 in accordance with an illustrative embodiment.
Figure 9:
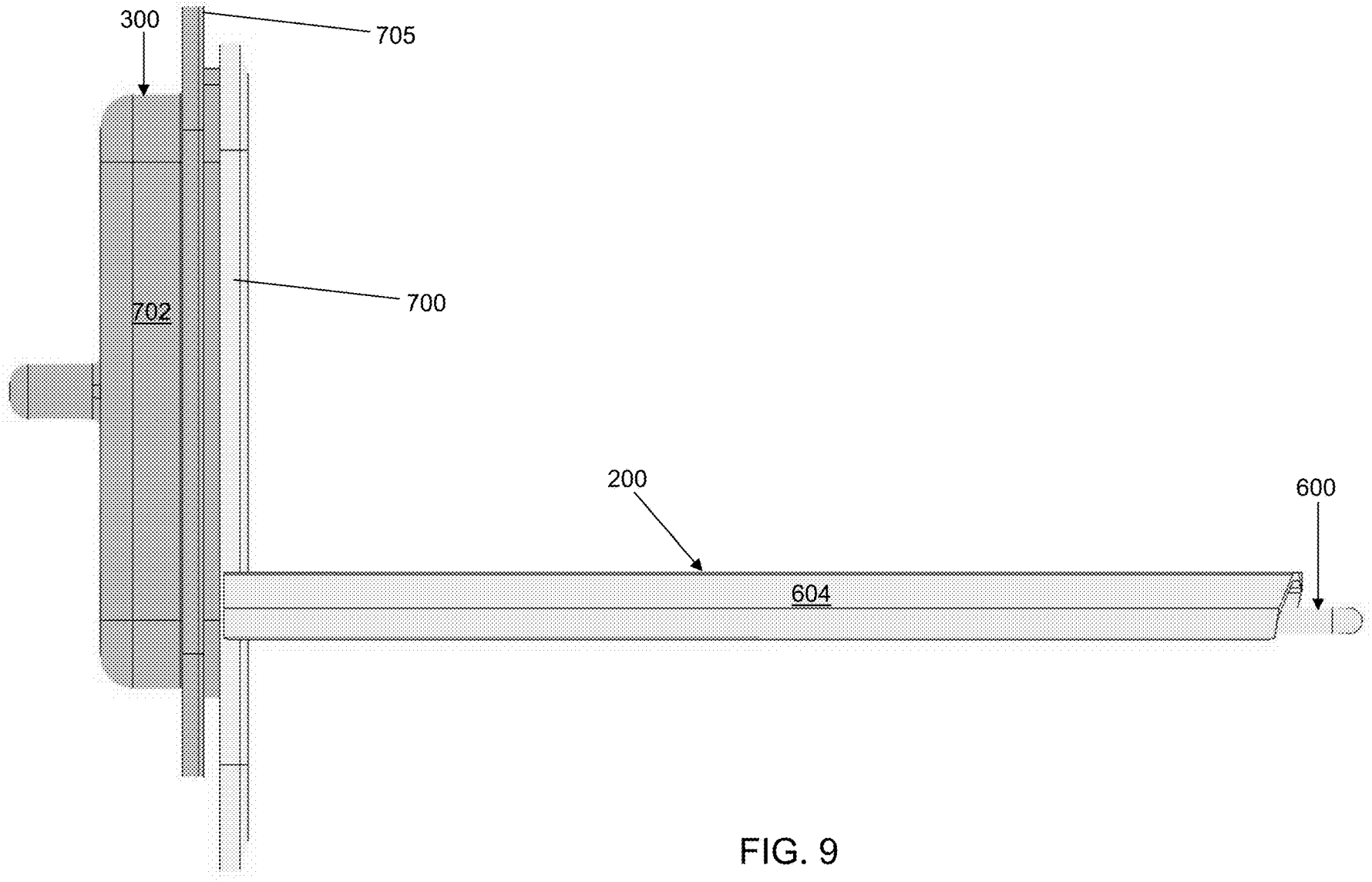
FIG. 9 depicts a front view of the shelf and adjustable shelf supports of FIG. 6 in accordance with an illustrative embodiment.
Figure 10:
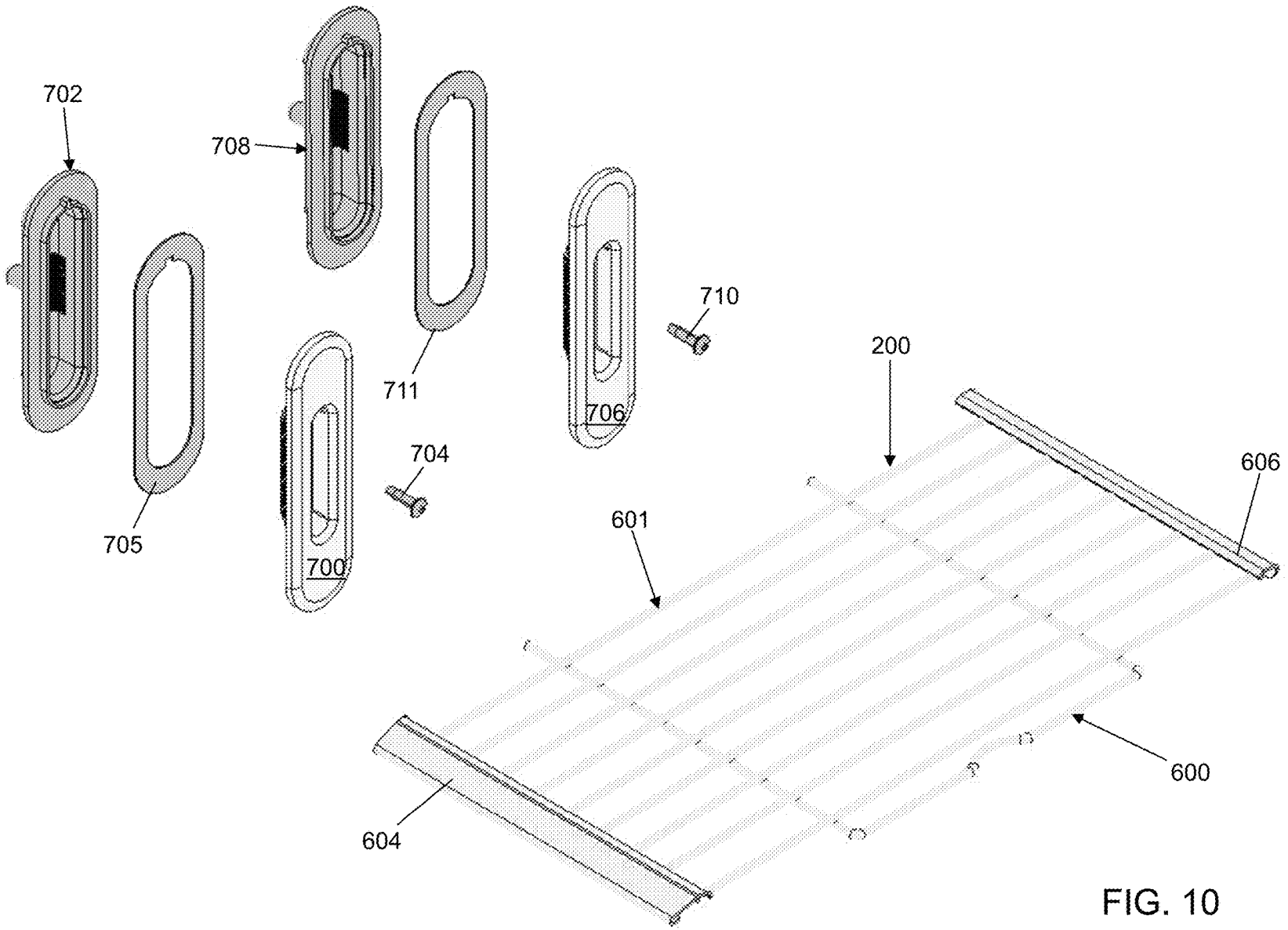
FIG. 10 depicts an exploded, right, front perspective view of the shelf and adjustable shelf supports of FIG. 6 in accordance with an illustrative embodiment.

Referring to FIG. 6, a right, front perspective view is shown of adjustable shelf 200, first adjustable shelf support 300, and second adjustable shelf support 400 in accordance with an illustrative embodiment. Referring to FIG. 7, a right view is shown of adjustable shelf 200, first adjustable shelf support 300, and second adjustable shelf support 400 in accordance with an illustrative embodiment. Referring to FIG. 8, a left view is shown of adjustable shelf 200, first adjustable shelf support 300, and second adjustable shelf support 400 in accordance with an illustrative embodiment. Referring to FIG. 9, a front view is shown of adjustable shelf 200, first adjustable shelf support 300, and second adjustable shelf support 400 in accordance with an illustrative embodiment. Referring to FIG. 10, an exploded, right, front perspective view is shown of adjustable shelf 200, first adjustable shelf support 300, and second adjustable shelf support 400 in accordance with an illustrative embodiment.

Referring to FIG. 6, adjustable shelf 200 may include shelf support bar 600, an item support surface 601, a shelf nose 604, and a shelf back edge support 606. In the illustrative embodiment, item support surface 601 extends lengthwise between and mounts to shelf nose 604 at a first end and to shelf back edge support 606 at a second end though shelf nose 604 and shelf back edge support 606 may not be included in an alternative embodiment. Shelf support bar 600 is mounted to a bottom surface of the item support surface 601 though it could be mounted to a top surface in an alternative embodiment. In the illustrative embodiment, item support surface 601 includes a plurality of parallel tines 602 that extend lengthwise between shelf nose 604 and shelf back edge support 606. In an alternative embodiment, item support surface 601 may include a plurality of parallel tines 602 that extend in other directions to provide a support surface for items. In an alternative embodiment, item support surface 601 may be a solid surface, for example, formed of glass, plastic, or other material that is strong enough to support items.

Shelf support bar 600 may include a first shelf arm 608, a second shelf arm 610, and a third shelf arm 612 that form a U-shape, where second shelf arm 610 is mounted between first shelf arm 608 and third shelf arm 612. First bar edge 614 is located at an edge of first shelf arm 608 opposite an end where first shelf arm 608 mounts to second shelf arm 610. Second bar edge 616 is located at an edge of third shelf arm 612 opposite an end where third shelf arm 612 mounts to second shelf arm 610. Though described as comprised of discrete components, shelf support bar 600 may be formed of a single piece of material, such as metal, rigid plastic, glass, etc., bent to form the U-shape. In an alternative embodiment, shelf support bar 600 may include a fewer or a greater number of arms that may provide support for item support surface 601 and connectivity to sidewalls.

In an alternative embodiment, first shelf arm 608 and third shelf arm 612 may not extend continuously under or over item support surface 601. For example, first shelf arm 608 may be segmented into a first portion and a second portion. First bar edge 614 may be located at an edge of the first portion of first shelf arm 608, and the second portion of first shelf arm 608 may be mounted to second shelf arm 610 to mount second shelf arm 610 to item support surface 601. Similarly, third shelf arm 612 may be segmented into a first portion and a second portion. Second bar edge 616 may be located at an edge of the first portion of third shelf arm 612, and the second portion of third shelf arm 612 may be mounted to second shelf arm 610 to further mount second shelf arm 610 to item support surface 601.

In the illustrative embodiment, second shelf arm 610 is mounted to the left sidewall of ice maker/dispenser 124. First bar edge 614 of first shelf arm 608 is mounted to rest on a portion of first adjustable shelf support 300. Second bar edge 616 of third shelf arm 612 is mounted to rest on a portion of second adjustable shelf support 400.

First adjustable shelf support 300 may include a first slidable support 700, a first stationary support 702, a first fastener 704, and a first gasket 705. Second adjustable shelf support 400 may include a second slidable support 706, a second stationary support 708, a second fastener 710, and a second gasket 711. Second fastener 710 may be identical to and interchangeable with first fastener 704. In an illustrative embodiment, first fastener 704 and second fastener 710 are plastite screws though other types of fasteners as well as screws formed of other materials may be used. First adjustable shelf support 300 and second adjustable shelf support 400 may be identical and interchangeable. A fewer or a greater number of adjustable shelf supports may be used in alternative embodiments to support adjustable shelf 200.

Figure 11B:
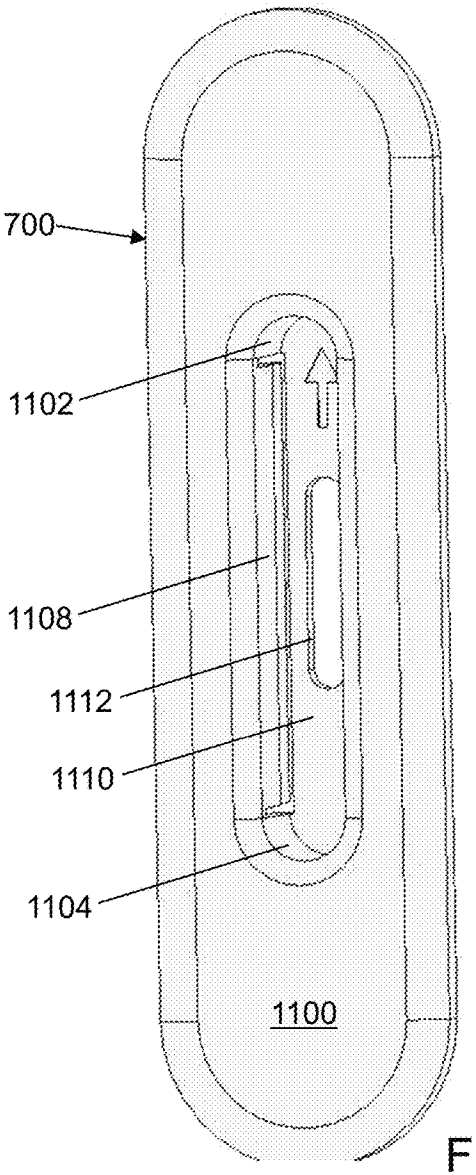
FIG. 11B depicts a right, back perspective view of the slidable shelf support of FIG. 11A in accordance with an illustrative embodiment.
Figure 11A:
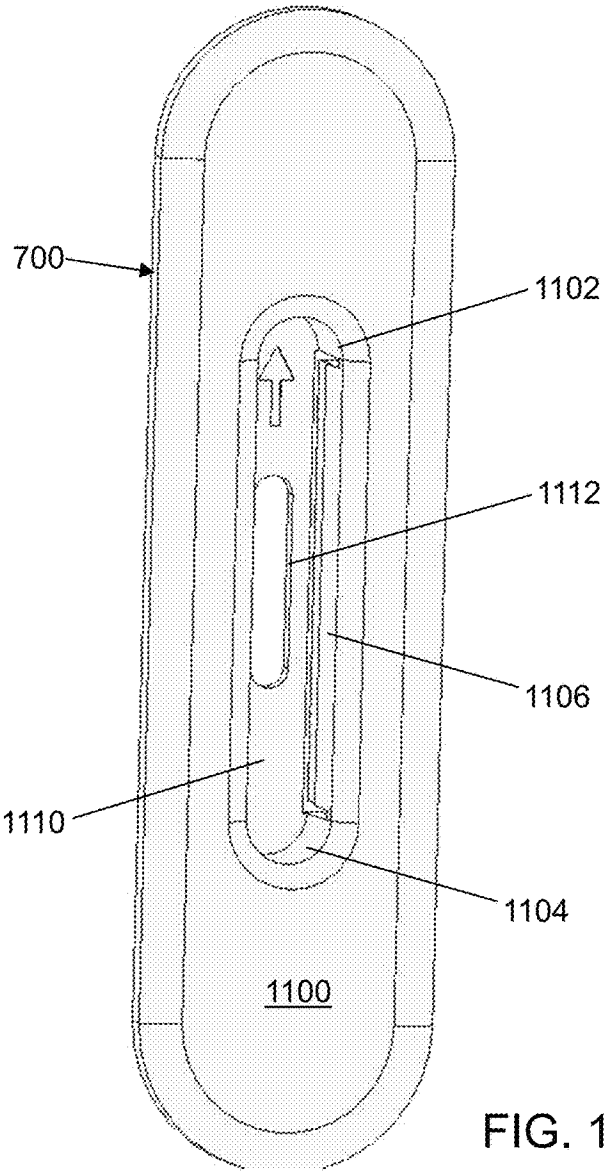
FIG. 11A depicts a right, front perspective view of a slidable shelf support of the adjustable shelf supports of FIG. 6 in accordance with an illustrative embodiment.
Figure 11C:
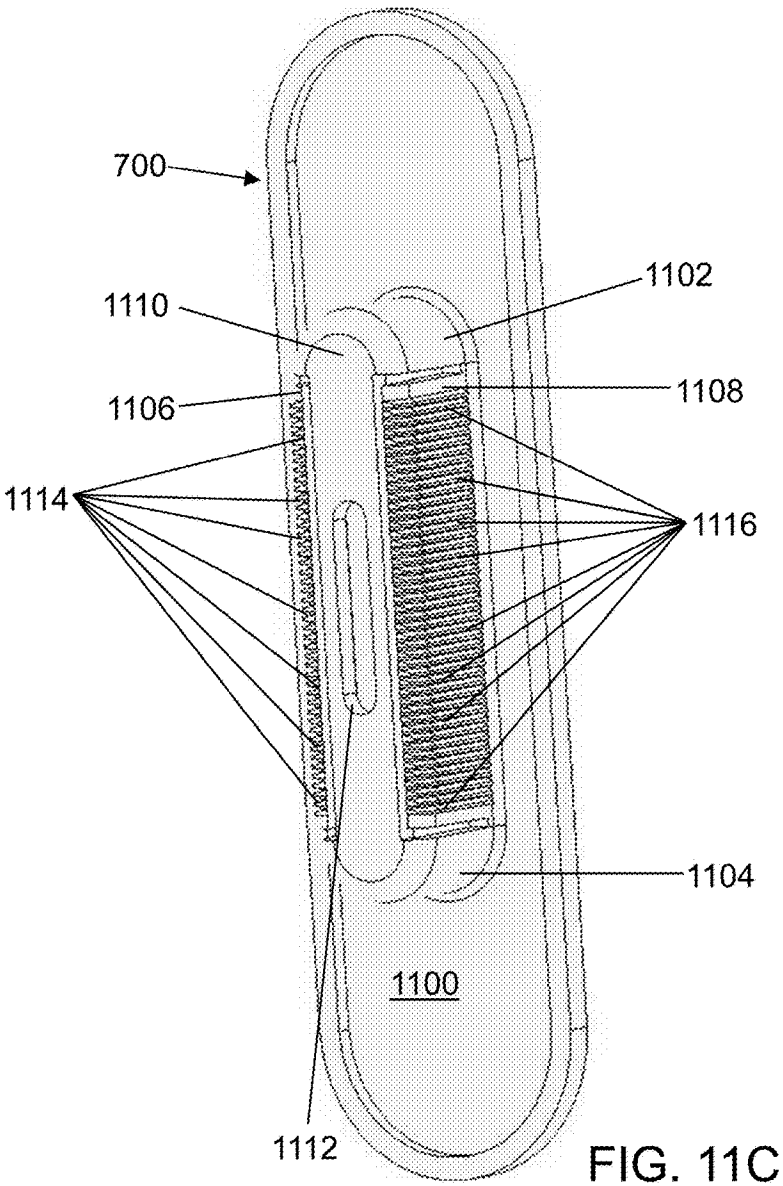
FIG. 11C depicts a left, front perspective view of the slidable shelf support of FIG. 11A in accordance with an illustrative embodiment.
Figure 11D:
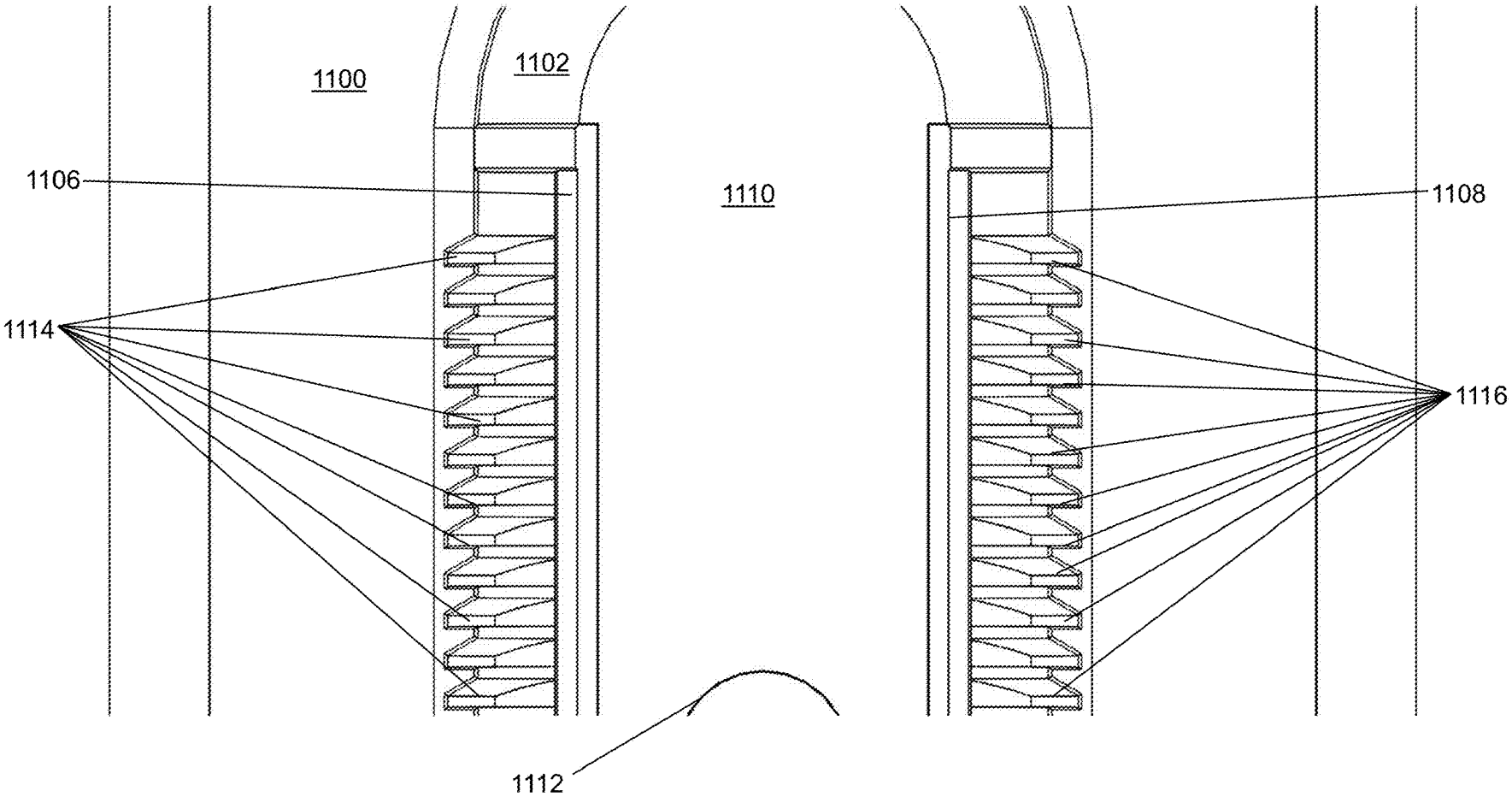
FIG. 11D depicts a zoomed left view of the slidable shelf support of FIG. 11A in accordance with an illustrative embodiment.

Referring to FIG. 11A, a right, front perspective view is shown of first slidable support 700 in accordance with an illustrative embodiment. Referring to FIG. 11B, a right, back perspective view is shown of first slidable support 700 in accordance with an illustrative embodiment. Referring to FIG. 11C, a left, front perspective view is shown of first slidable support 700 in accordance with an illustrative embodiment. Referring to FIG. 11D, a zoomed left view is shown of first slidable support 700 in accordance with an illustrative embodiment. Second slidable support 706 may be identical to and interchangeable with first slidable support 700.

First slidable support 700 may include a slidable front wall 1100, a top cavity sidewall 1102, a bottom cavity sidewall 1104, a right cavity tabbed wall 1106, a left cavity tabbed wall 1108, and a slidable back wall 1110. Slidable front wall 1100 is generally flat and abuts an interior surface of interior liner wall 302 of left side wall 108 when first adjustable shelf support 300 is mounted to left side wall 108.

Top cavity sidewall 1102, bottom cavity sidewall 1104, right cavity tabbed wall 1106, and left cavity tabbed wall 1108 are mounted to an interior edge of slidable front wall 1100 and form a sidewall that extends away from slidable front wall 1100. The interior edge of slidable front wall 1100 forms an aperture that has an oval racetrack shape in the illustrative embodiment. Right cavity tabbed wall 1106 and left cavity tabbed wall 1108 are formed as tabs separated on either end from top cavity sidewall 1102 and bottom cavity sidewall 1104 so that right cavity tabbed wall 1106 and left cavity tabbed wall 1108 can more easily deflect inward and outward relative to top cavity sidewall 1102 and bottom cavity sidewall 1104. In the illustrative embodiment, first bar edge 614 and second bar edge 616 of shelf support bar 600 are supported by bottom cavity sidewall 1104 of first adjustable shelf support 300 and of second adjustable shelf support 400, respectively. First bar edge 614 and second bar edge 616 extend outward away from item support surface 601 a sufficient distance to allow first bar edge 614 and second bar edge 616 to be supported by bottom cavity sidewall 1104 of first adjustable shelf support 300 and of second adjustable shelf support 400, respectively. Bottom cavity sidewall 1104 is further sized and shaped to accommodate first bar edge 614 or second bar edge 616.

Slidable back wall 1110 extends between top cavity sidewall 1102 and bottom cavity sidewall 1104 and has a shape similar to the aperture formed by the interior edge of slidable front wall 1100. A back aperture wall 1112 is formed through slidable back wall 1110 to allow insertion of first fastener 704 along a vertical extent so that first slidable support 700 can be adjusted vertically relative to first stationary support 702.

A back surface of right cavity tabbed wall 1106 includes a plurality of right ledges 1114. A back surface of left cavity tabbed wall 1108 includes a plurality of left ledges 1116. The plurality of right ledges 1114 protrudes outward from the back surface of right cavity tabbed wall 1106. The plurality of left ledges 1116 protrudes outward from the back surface of left cavity tabbed wall 1108. In an alternative embodiment, a back plurality of ledges (not shown) protrudes outward from a back surface of slidable back wall 1110.

Figure 12B:
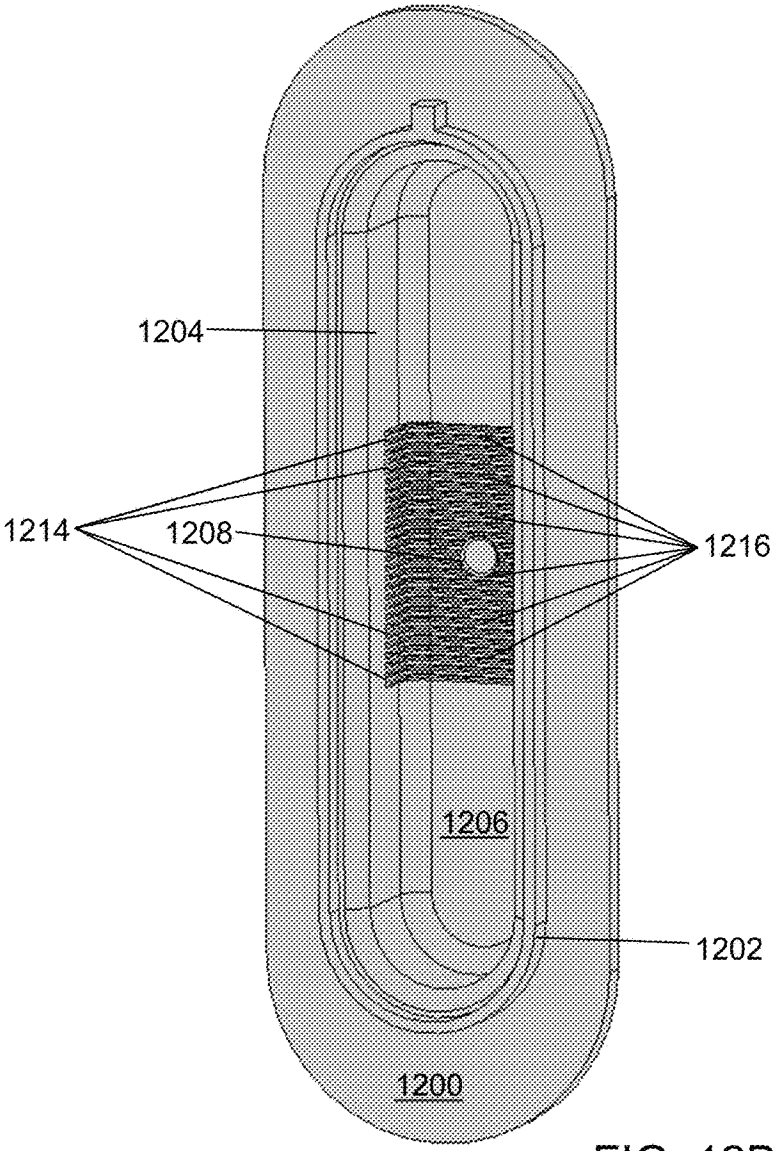
FIG. 12B depicts a right, back perspective view of the stationary shelf support of FIG. 12A in accordance with an illustrative embodiment.
Figure 12A:
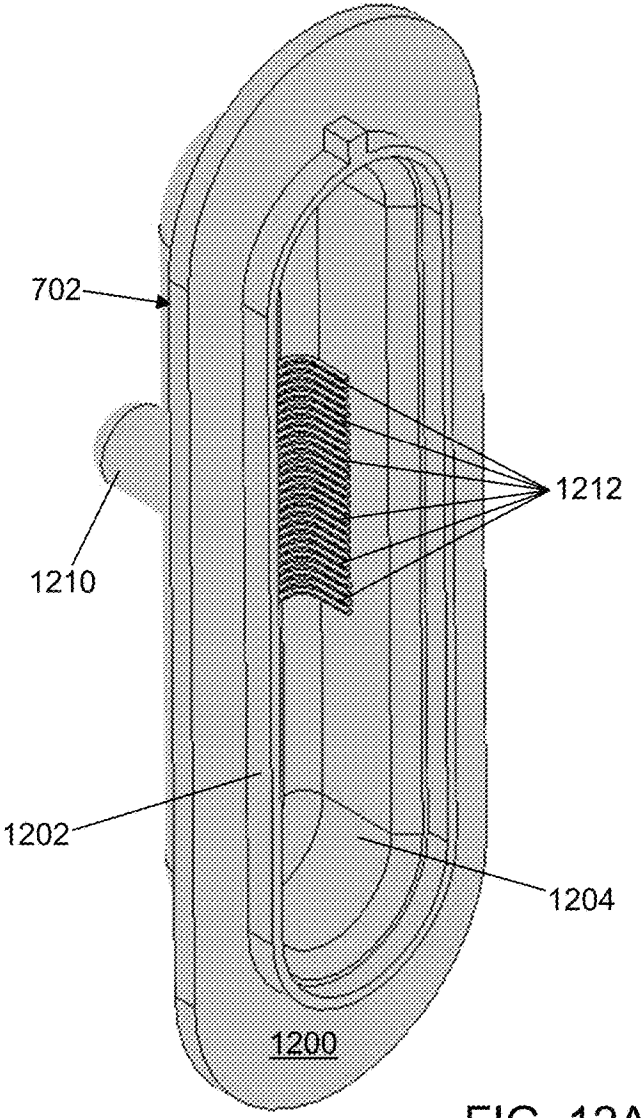
FIG. 12A depicts a right, front perspective view of a stationary shelf support of the adjustable shelf supports of FIG. 6 in accordance with an illustrative embodiment.
Figure 12C:
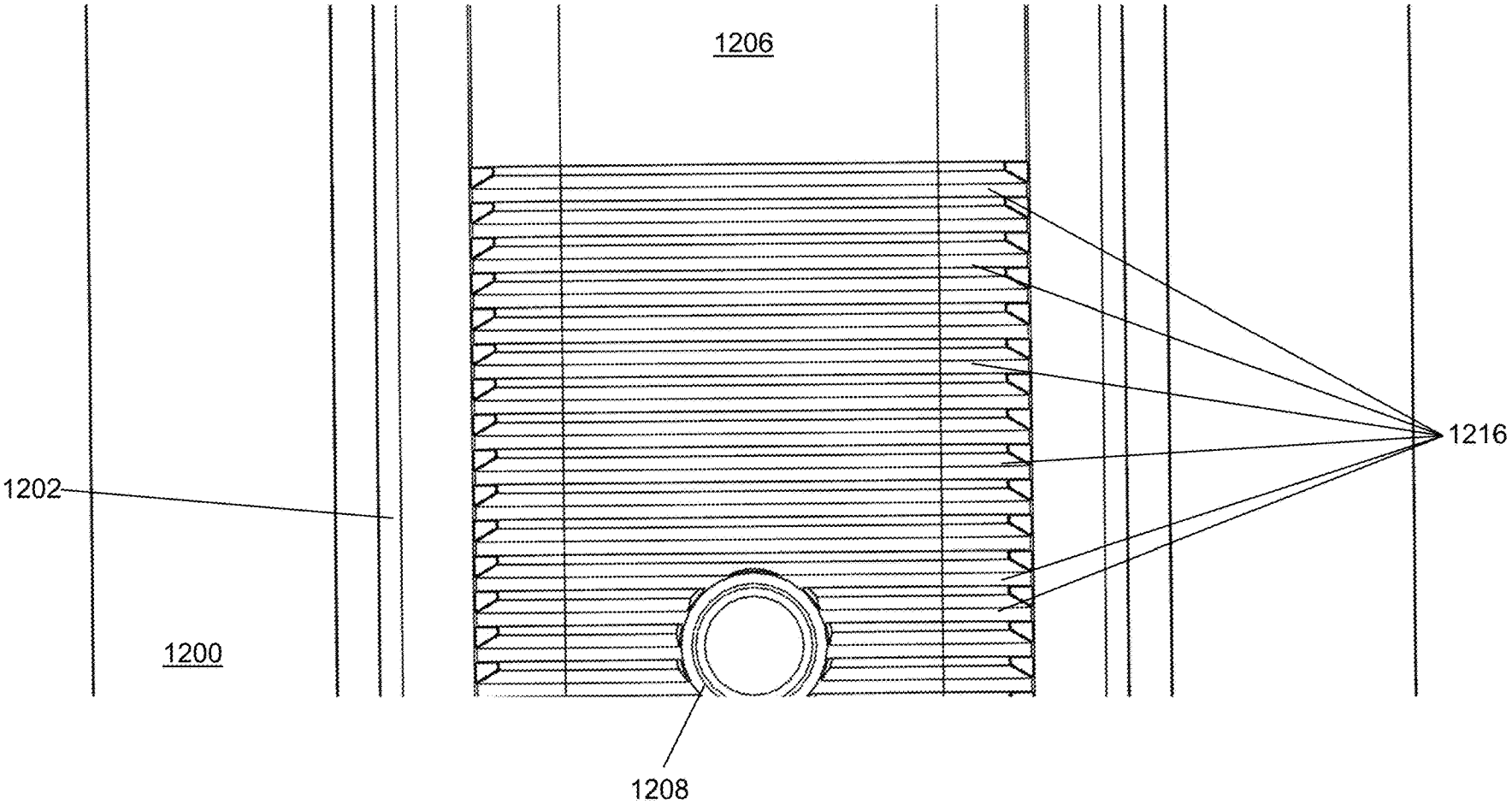
FIG. 12C depicts a zoomed right view of the stationary shelf support of FIG. 12A in accordance with an illustrative embodiment.
Figure 12D:
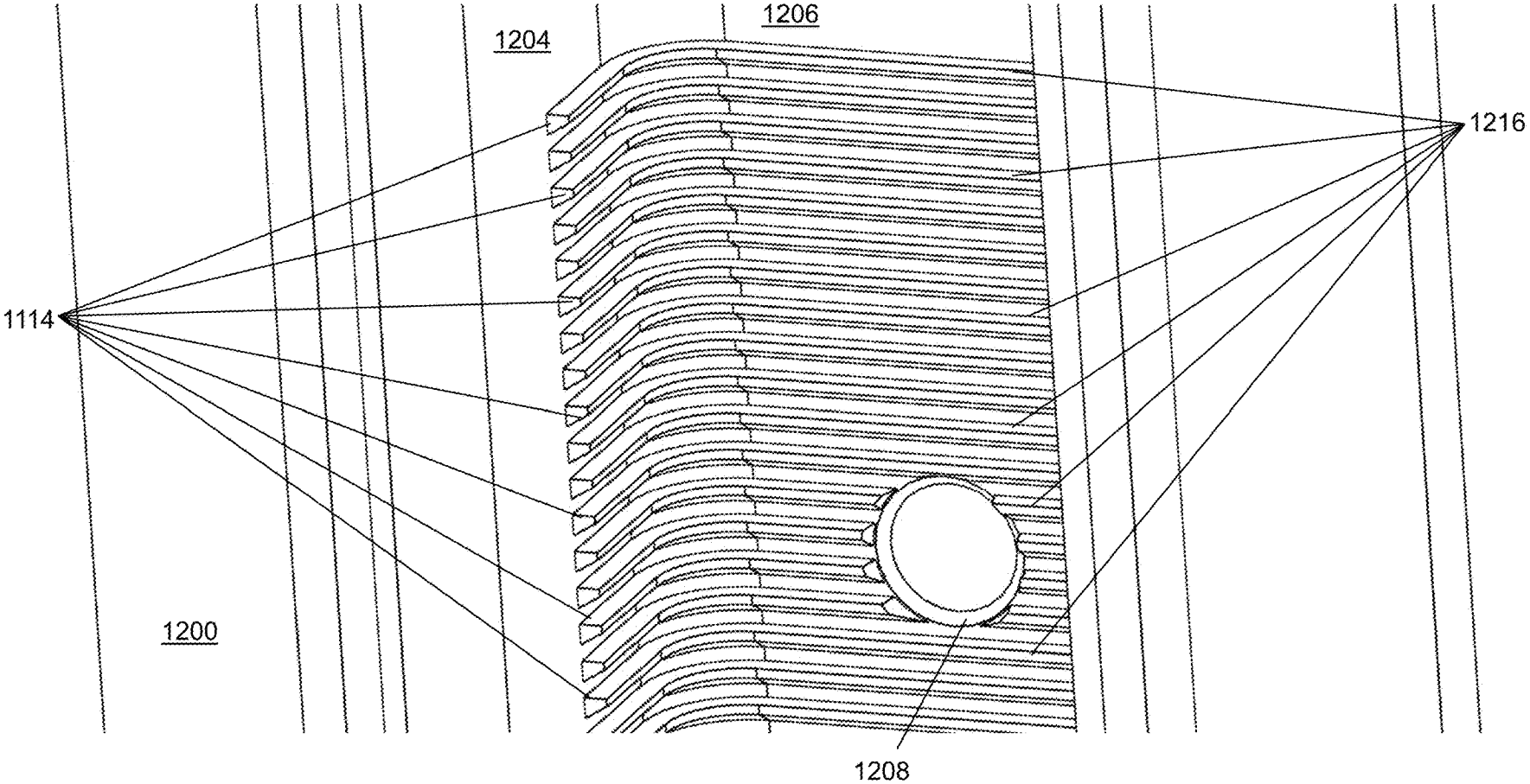
FIG. 12D depicts a zoomed right, back perspective view of the stationary shelf support of FIG. 12A in accordance with an illustrative embodiment.
Figure 12E:
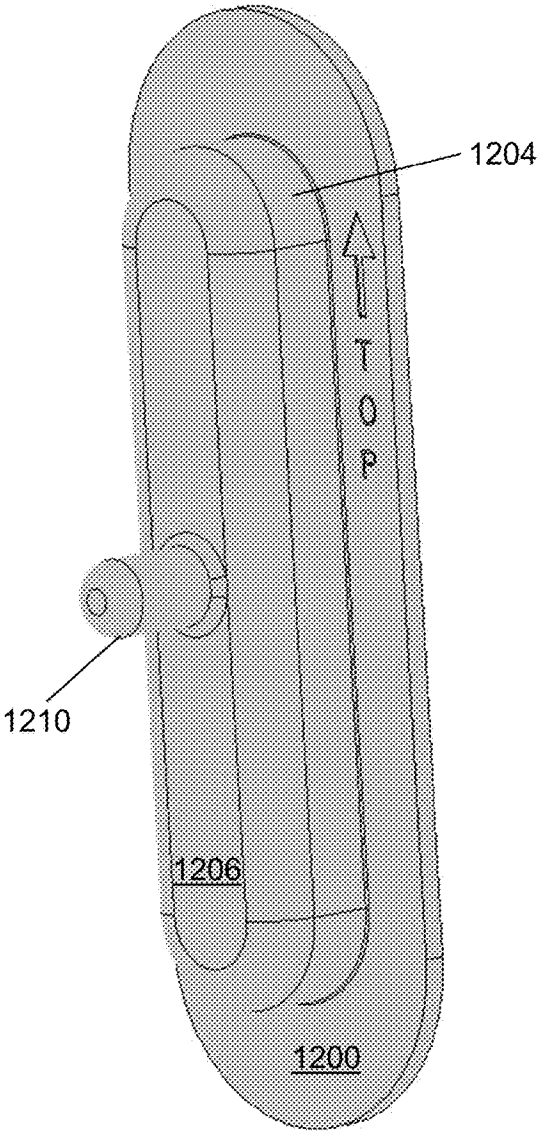
FIG. 12E depicts a left, front perspective view of the stationary shelf support of FIG. 12A in accordance with an illustrative embodiment.

Referring to FIG. 12A, a right, front perspective view is shown of first stationary support 702 in accordance with an illustrative embodiment. Referring to FIG. 12B, a right, back perspective view is shown of first stationary support 702 in accordance with an illustrative embodiment. Referring to FIG. 12C, a zoomed right view is shown of first stationary support 702 in accordance with an illustrative embodiment. Referring to FIG. 12D, a zoomed right, back perspective view is shown of first stationary support 702 in accordance with an illustrative embodiment. Referring to FIG. 12E, a left, front perspective view is shown of first stationary support 702 in accordance with an illustrative embodiment. Second stationary support 708 may be identical to and interchangeable with first stationary support 702.

First stationary support 702 may include a stationary front wall 1200, a front rib 1202, a sidewall 1204, a stationary back wall 1206, a fastener aperture wall 1208, and a fastener protrusion 1210. Stationary front wall 1200 is generally flat. Front rib 1202 extends away from a top surface of stationary front wall 1200 surrounding an aperture formed in stationary front wall 1200 that has an oval racetrack shape in the illustrative embodiment.

Sidewall 1204 is mounted to extend away from an interior edge of the aperture formed in stationary front wall 1200 in a direction opposite to front rib 1202. Stationary back wall 1206 extends between edges of sidewall 1204 and has a shape similar to the aperture formed by the interior edge of stationary front wall 1200. Fastener aperture wall 1208 is formed through stationary back wall 1206 to allow insertion of first fastener 704 to mount first slidable support 700 to first stationary support 702. Fastener protrusion 1210 extends from fastener aperture wall 1208 to encompass first fastener 704 when first fastener 704 is inserted into fastener aperture wall 1208.

An interior surface of a right side of sidewall 1204 includes a stationary plurality of right ledges 1212. The stationary plurality of right ledges 1212 protrudes inward from the interior surface of the right side of sidewall 1204 toward a left side of sidewall 1204. An interior surface of the left side of sidewall 1204 includes a stationary plurality of left ledges 1212. The stationary plurality of left ledges 1214 protrudes inward from the interior surface of the left side of sidewall 1204 toward the right side of sidewall 1204. A front surface of stationary back wall 1206 above and below fastener aperture wall 1208 includes a plurality of back ledges 1216. The plurality of back ledges 1216 protrudes inward from the front surface of stationary back wall 1206 toward the aperture formed by the interior edge of stationary front wall 1200.

In the illustrative embodiment, each ledge of the stationary plurality of right ledges 1212, the stationary plurality of left ledges 1212, and the plurality of back ledges 1216 form a continuous shelf on which a ledge of the plurality of right ledges 1114 and a ledge of the plurality of left ledges 1116 are supported to position first slidable support 700 relative to first stationary support 702. A continuous shelf is not required. For example, in an alternative embodiment, the plurality of back ledges 1216 may not be included.

A fewer or a greater number of ledges may be included in the stationary plurality of right ledges 1212, the stationary plurality of left ledges 1212, the plurality of back ledges 1216, the plurality of right ledges 1114, and the plurality of left ledges 1116 based on a number of optional positions for mounting first slidable support 700 relative to first stationary support 702. A spacing further may be selected between the ledges to provide the number of optional positions for mounting first slidable support 700 relative to first stationary support 702. A size and a shape of each ledge of the stationary plurality of right ledges 1212, the stationary plurality of left ledges 1212, the plurality of back ledges 1216, the plurality of right ledges 1114, and the plurality of left ledges 1116 may be selected to provide a sufficient strength and rigidity and length to support adjustable shelf 200 and items placed on adjustable shelf 200. The size and the shape of each ledge of the stationary plurality of right ledges 1212, the stationary plurality of left ledges 1212, the plurality of back ledges 1216 may be selected to be complementary such that the plurality of right ledges 1114 and the plurality of left ledges 1116 rest on and are supported by the stationary plurality of right ledges 1212, the stationary plurality of left ledges 1212, and/or the plurality of back ledges 1216.

Figure 13:
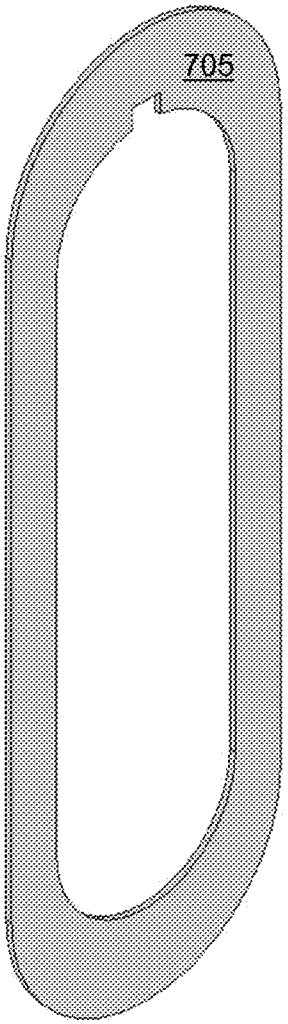
FIG. 13 depicts a right, front perspective view of a gasket of the adjustable shelf supports of FIG. 6 in accordance with an illustrative embodiment.

Referring to FIG. 13, a right, front perspective view is shown of first gasket 705 in accordance with an illustrative embodiment. First gasket 705 and second gasket 711 have a common size and shape and may be interchangeable. Stationary front wall 1200 is generally flat. A first face of first gasket 705 is positioned over front wall 1200 to surround front rib 1202 and a second face abuts an exterior surface of interior liner wall 302 of left side wall 108 when first adjustable shelf support 300 is mounted to left side wall 108. First gasket 705 may have various thicknesses.

First adjustable shelf support 300 and second adjustable shelf support 400 provide a ratcheting adjustable pocket for locating a horizontal resting position of adjustable shelf 200 to account for cabinet variability during manufacture. First stationary support 702 is inserted in an aperture formed through interior liner wall 302 of left side wall 108. The aperture may have a similar size and shape relative to front rib 1202 such that front rib 1202 is inserted through the aperture and supported by interior liner wall 302 of left side wall 108. Optionally, first gasket 705 may be mounted to first stationary support 702 to provide a flush surface to abut the exterior surface of interior liner wall 302 of left side wall 108. First gasket 705 may be mounted to first stationary support 702, for example, using adhesive or another type of fastener. First gasket 705 may be mounted to the exterior surface of interior liner wall 302 of left side wall 108, for example, using adhesive or another type of fastener.

First slidable support 700 is inserted into first stationary support 702 with a vertical position selected using the complementary ledges to provide the horizontal resting position of adjustable shelf 200. First slidable support 700 may be slid up or down using right cavity tabbed wall 1106 and left cavity tabbed wall 1108 that can be deflected to ledge up or down within first stationary support 702. Engagement between the complementary ledges of first slidable support 700 and first stationary support 702 holds first slidable support 700 in position relative to first stationary support 702. First fastener 704 is inserted through back aperture wall 1112 and fastener aperture wall 1208 and is threaded into an interior surface of fastener protrusion 1210 to mount first slidable support 700 to first stationary support 702 at the selected vertical position.

First slidable support 700 and/or first stationary support 702 may be formed of a single continuous piece of material, for example, by molding, or may be formed of multiple distinct pieces mounted together or attached to each other, for example, using various fasteners including adhesive, a screw, a rivet, etc. First adjustable shelf support 300 and second adjustable shelf support 400 may be formed of one or more materials such as metal, wood, plastic, etc. having a sufficient strength and rigidity and aesthetic value to provide the illustrated and/or described function. In the illustrative embodiment, only a front face of first slidable support 700 is readily visible to a consumer.

Though shown in the illustrative embodiment as having complementary oval shapes, first slidable support 700 and first stationary support 702 may have other shapes and need not be complementary in shape except that first slidable support 700 is sized to fit within first stationary support 702 such that the plurality of right ledges 1114 and the plurality of left ledges 1116 can mate with the stationary plurality of right ledges 1212, the stationary plurality of left ledges 1212, and/or the plurality of back ledges 1216.

As used in this disclosure, the term "mount" is intended to define a structural connection between two or more elements and includes join, unite, connect, couple, associate, insert, hang, hold, affix, attach, fasten, bind, paste, secure, bolt, screw, rivet, solder, weld, glue, adhere, form over, layer, and other similar terms. The phrases "mounted on" and "mounted to" include any interior or exterior portion of the elements referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. An adjustable shelf support comprising:

a fastener;

a stationary support, wherein the stationary support comprises a first body, a first aperture wall formed through the first body that surrounds a first aperture, and a first plurality of ledges that protrude outward away from the first body; and a slidable support comprising a second body, a second aperture wall formed through the second body that surrounds a second aperture, and a second plurality of ledges that protrude outward away from the second body, wherein a ledge of the second plurality of ledges is positioned on a ledge of the first plurality of ledges to mount the slidable support to the stationary support, wherein the fastener is inserted through the second aperture wall and the first aperture wall to further mount the slidable support to the stationary support.

2. The adjustable shelf support of claim 1, wherein the second aperture is elongated in a vertical direction relative to a horizontal direction that is perpendicular to the vertical direction.

3. The adjustable shelf support of claim 1, wherein the first body of the stationary support comprises a back wall, a right sidewall, and a left sidewall, wherein the right sidewall extends from a right edge of the back wall, wherein the left sidewall extends from a left edge of the back wall, wherein the first plurality of ledges protrudes outward away from the right sidewall and away from the left sidewall toward the second body.

4. The adjustable shelf support of claim 3, wherein the first plurality of ledges further protrudes outward away from the back wall toward the second body.

5. The adjustable shelf support of claim 4, wherein the first aperture is formed through the back wall.

6. The adjustable shelf support of claim 3, wherein the second body of the slidable support comprises a second back wall, a second right sidewall, a second left sidewall, and a bottom wall, wherein the second right sidewall extends from a right edge of the second back wall, wherein the second left sidewall extends from a left edge of the second back wall, wherein the bottom wall extends from a bottom edge of the second back wall.

7. The adjustable shelf support of claim 6, wherein the second plurality of ledges protrudes outward away from the second right sidewall and away from the second left sidewall toward the first body.

8. The adjustable shelf support of claim 3, wherein the second body of the slidable support comprises a second back wall, a second right sidewall, a second left sidewall, a bottom wall, and a front wall, wherein the bottom wall extends between a bottom edge of the second back wall and the front wall, wherein the front wall extends from a front edge of the second right sidewall, a front edge of the second left sidewall, and a front edge of the second back wall, wherein the second right sidewall extends from a right edge of the front wall towards the second back wall, wherein the second left sidewall extends from a left edge of the front wall towards the second back wall.

9. The adjustable shelf support of claim 8, wherein a first gap is formed between the second right sidewall and the second back wall, wherein a second gap is formed between the second right sidewall and the bottom wall, wherein a third gap is formed between the second left sidewall and the second back wall, wherein a fourth gap is formed between the second left sidewall and the bottom wall.

10. The adjustable shelf support of claim 8, wherein the second plurality of ledges protrudes outward away from the second right sidewall and away from the second left sidewall toward the first body.

11. The adjustable shelf support of claim 10, wherein the first plurality of ledges further protrudes outward away from the back wall toward the second body.

12. The adjustable shelf support of claim 8, wherein the second aperture is formed through the second back wall, wherein the second aperture is elongated in a vertical direction relative to a horizontal direction that is perpendicular to the vertical direction.

13. The adjustable shelf support of claim 12, wherein the first aperture is formed through the back wall.

14. An adjustable shelf comprising:

a fixed support bracket;

an item support surface;

a shelf support bar mounted to the item support surface, wherein the shelf support bar comprises a first edge and a second edge, wherein the first edge is on an opposite side of the shelf support bar relative to the second edge, wherein the second edge is mounted to the fixed support bracket; and an adjustable shelf support comprising a fastener;

a stationary support, wherein the stationary support comprises a first body, a first aperture wall formed through the first body that surrounds a first aperture, and a first plurality of ledges that protrude outward away from the first body; and a slidable support comprising a second body, a second aperture wall formed through the second body that surrounds a second aperture, and a second plurality of ledges that protrude outward away from the second body, wherein a ledge of the second plurality of ledges is positioned on a ledge of the first plurality of ledges to mount the slidable support to the stationary support, wherein the fastener is inserted through the second aperture wall and the first aperture wall to further mount the slidable support to the stationary support, wherein the first edge is mounted to the slidable support.

15. A refrigerator comprising:

a plurality of walls;

a door mounted to a wall of the plurality of walls, wherein the plurality of walls and the door define an enclosed space;

a refrigeration system;

a fixed support bracket mounted to a first interior wall within the refrigerator;

an item support surface;

a shelf support bar mounted to the item support surface, wherein the shelf support bar comprises a first edge and a second edge, wherein the first edge is on an opposite side of the shelf support bar relative to the second edge, wherein the second edge is mounted to the fixed support bracket; and a first adjustable shelf support comprising a first fastener;

a first stationary support mounted to a second interior wall within the refrigerator, wherein the first stationary support comprises a first body, a first aperture wall formed through the first body that surrounds a first aperture, and a first plurality of ledges that protrude outward away from the first body; and a first slidable support comprising a second body, a second aperture wall formed through the second body that surrounds a second aperture, and a second plurality of ledges that protrude outward away from the second body, wherein a ledge of the second plurality of ledges is positioned on a ledge of the first plurality of ledges to mount the slidable support to the stationary support, wherein the first fastener is inserted through the second aperture wall and the first aperture wall to further mount the slidable support to the stationary support, wherein the first edge is mounted to the first slidable support.

16. The refrigerator of claim 15, further comprising:

a second adjustable shelf support comprising a second fastener;

a second stationary support mounted to the second interior wall within the refrigerator, wherein the second stationary support comprises a third body, a third aperture wall formed through the third body, and a third plurality of ledges that protrude outward away from the third body; and a second slidable support comprising a fourth body, a fourth aperture wall formed through the fourth body, and a fourth plurality of ledges that protrude outward away from the fourth body, wherein a ledge of the fourth plurality of ledges is positioned on a ledge of the third plurality of ledges, wherein the second fastener is inserted through the fourth aperture wall and the third aperture wall, wherein the shelf support bar further comprises a third edge, wherein the third edge is on the opposite side of the shelf support bar relative to the second edge, wherein the third edge is mounted to the second slidable support.

17. The refrigerator of claim 15, further comprising an ice maker assembly mounted to at least one wall of the plurality of walls, wherein the first interior wall within the refrigerator is an exterior wall of the ice maker assembly.

18. The refrigerator of claim 17, wherein the second interior wall within the refrigerator is a liner wall of the refrigerator.

19. The refrigerator of claim 18, wherein the first stationary support is mounted to a first side of the liner wall of the refrigerator, and the first slidable support is mounted to a second side of the liner wall of the refrigerator, wherein the second side of the liner wall is in an interior of the refrigerator.

20. The refrigerator of claim 15, wherein the item support surface is rotatable relative to the fixed support bracket and upward away from the first adjustable shelf support.

* * * * *